US007827642B2

(12) United States Patent
Han

(10) Patent No.: US 7,827,642 B2
(45) Date of Patent: Nov. 9, 2010

(54) HOLLOW PRESTRESSED CONCRETE (HPC) GIRDER AND SPLICED HOLLOW PRESTRESSED CONCRETE GIRDER (S-HPC) BRIDGE CONSTRUCTION METHOD

(76) Inventor: Man-Yop Han, Ingye-dong, Paldal-gu, 304-1302 SK Apt., Suwon-City (KR) 442-070

( * ) Notice: Subject to any disclaimer, the term of this patent is extended or adjusted under 35 U.S.C. 154(b) by 0 days.

(21) Appl. No.: 11/575,963

(22) PCT Filed: Sep. 24, 2005

(86) PCT No.: PCT/KR2005/003182

§ 371 (c)(1),
(2), (4) Date: Mar. 23, 2007

(87) PCT Pub. No.: WO2006/033565

PCT Pub. Date: Mar. 30, 2006

(65) Prior Publication Data

US 2008/0060146 A1 Mar. 13, 2008

(30) Foreign Application Priority Data

Sep. 25, 2004 (KR) ..... 10-2004-0077622
Sep. 23, 2005 (KR) ..... 10-2005-0088701

(51) Int. Cl.
*E01D 2/02* (2006.01)

(52) U.S. Cl. ..... 14/74.5; 52/223.11

(58) Field of Classification Search ..... 14/3, 14/9, 74.5, 77.1, 78; 52/169, 223.11; 96/3, 96/9, 74.5, 77.1, 78
See application file for complete search history.

(56) References Cited

U.S. PATENT DOCUMENTS 2,883,728 A * 4/1959 Sederlund ..... 249/50
3,349,527 A * 10/1967 Bruns ..... 52/169.9
3,944,242 A * 3/1976 Eubank ..... 280/30

(Continued)

FOREIGN PATENT DOCUMENTS

| | | |
|---|---|---|
| JP | 05-009910 | 1/1993 |
| JP | 09-025611 | 1/1997 |
| JP | 09-071907 | 3/1997 |
| JP | 2002-371516 | 12/2002 |
| KR | EP 1548190 A2 * | 5/2005 |

*Primary Examiner*—Raymond W Addie
(74) *Attorney, Agent, or Firm*—Park & Associates IP Law LLC

(57) ABSTRACT

Provided is a hollow prestressed concrete girder for forming an I-type prestressed concrete girder bridge, in which at least one hole is formed in a body portion of the I-type prestressed concrete girder. A spliced hollow prestressed concrete girder bridge, in which a plurality of holes are formed in a body portion of the girder to reduce the weight of the girder, is constructed by carrying a plurality of spliced girders manufactured in a factory to a construction site, assembling the spliced girders in the construction site, first tensing steel wires installed at the entire girder, reinforcing a connection portion between spliced members by a steel rod or steel wire which is connected by welding or using a coupling or anchoring device at the spliced portion that connecting the spliced girders, installing the assembled girders that are first tensed on a pier, installing a continuous steel wire for connecting the installed spliced girders for a continuous bridge, pouring slab in the upper portion of the installed spliced girders, after the slab is cured, second tensing steel wires that have not tensed or the tensed continuous steel wire, and when cracks are generated or excessive sagging occurs after the bridge is constructed, additionally tensing the steel wires.

12 Claims, 7 Drawing Sheets

U.S. PATENT DOCUMENTS 3,977,646 A * 8/1976 Moon et al. ..... 249/50
3,983,830 A * 10/1976 Morgan ..... 114/77 R
5,299,445 A * 4/1994 Yee ..... 52/745.19
5,577,284 A * 11/1996 Muller ..... 14/73
5,671,573 A * 9/1997 Tadros et al. ..... 52/223.8
5,839,539 A * 11/1998 Smith ..... 182/150
6,036,906 A * 3/2000 Tadros et al. ..... 264/228
6,101,781 A * 8/2000 Balzer ..... 52/724.1
6,345,403 B1 * 2/2002 Nagle ..... 14/77.1
6,751,821 B1 * 6/2004 Han ..... 14/74.5
7,010,890 B2 * 3/2006 DeSutter ..... 52/223.8
7,104,017 B1 * 9/2006 Kadotani et al. ..... 52/223.8
2005/0144890 A1 * 7/2005 Kim et al. ..... 52/720.1
2006/0137115 A1 * 6/2006 Park ..... 14/74.5
2006/0272267 A1 * 12/2006 Mentado-Duran ..... 52/693
2007/0056123 A1 * 3/2007 Moon ..... 14/77.1

* cited by examiner

HOLLOW PRESTRESSED CONCRETE (HPC) GIRDER AND SPLICED HOLLOW PRESTRESSED CONCRETE GIRDER (S-HPC) BRIDGE CONSTRUCTION METHOD

TECHNICAL FIELD

The present invention relates to a hollow prestressed concrete girder and a method of constructing a spliced hollow prestressed concrete girder bridge, and more particularly, to a hollow prestressed concrete girder which can greatly increase the span of a girder, and to a method of constructing a spliced hollow prestressed concrete girder bridge.

BACKGROUND ART

In general, an I-type prestressed concrete girder bridge having an I-shaped section is one of bridges that are inexpensive and widely used in the world. However, for the I-type girder bridge, when the length of a girder exceeds 40-50 m, the length and weight of the girder increase so that all processes such as manufacturing, carrying and installing of the girder become very difficult. Thus, for a concrete box type girder, a bridge is constructed in a method of connecting a plurality of splice members that are as short as 2-3 m.

In the conventional I-type girder bridge, since steel wires are mostly installed at an end portion of a girder, the steel wires cannot be installed according to the moment distribution property which increases in the middle portion of the girder so that the amount of steel wires and the size of the section of the girder increase as a whole. Also, since the size of the end portion of the girder needs to be made large, the weight of the girder increases and the manufacture of a mold becomes difficult.

Conventionally, to efficiently construct a long span I-type girder bridge, a girder is manufactured by dividing into a plurality of splices and the spliced girders are moved to a construction site and combined together there. For the concrete box girder bridge, a construction method using 15 or more splices per span is generally and widely used. However, for the I-type girder, it is very rare to use the spliced girder and such a method is used only for a small bridge or at a construction site such as a mountain area where the construction is difficult. In particular, in the spliced girder bridge, when a load is applied, destruction starts in a spliced portion so that the load carrying capacity of the spliced girder bridge is lowered by 20-30% compared to an integral type girder bridge and it can be said that the spliced girder bridge has an inefficient structural property.

Furthermore, in a conventional incrementally prestressed girder bridge, the installation position of an anchoring device of steel wires for prestressing is limited to the side surface of the end portion of the girder. Thus, since the installation position of the anchoring device is not free, the dynamically efficient arrangement of steel wires is difficult in view of the whole girder.

Also, since the conventional girder bridge has a structure in which a body portion is closed, not only the weight increases but also the bridge shows weakness to a load such as wind or water acting in a direction perpendicular to the girder. Also, the closed body portion of the girder gives a feeling of being locked in.

DISCLOSURE OF INVENTION

Technical Problem

To solve the above and/or other problems, the present invention provides a hollow prestressed concrete girder and a method of constructing a spliced hollow prestressed concrete girder bridge, which can reduce the weight of the girder by introducing a hole in the body portion of the I-type girder, efficiently arrange steel wires by installing an anchoring device, increase the maximum span of the girder, decrease the weight of the girder, reduce costs for constructing a girder bridge, and remarkably improve construction conditions such as carrying and installing of the girder.

Also, the present invention provides a hollow prestressed concrete girder and a method of constructing a spliced hollow prestressed concrete girder bridge, which can increase a load carrying capacity to that of an integral type girder by appropriately installing tensile reinforcement member such as a steel wire or steel rod partially at a lower end of the spliced portion of the spliced girder and increasing the load carrying capacity of the spliced girder by inventing a concept and method for preventing the lowering of the tensile force of the lower end of the spliced girder.

Also, the present invention provides a hollow prestressed concrete girder and a method of constructing a spliced hollow prestressed concrete girder bridge, which can fix the steel wire at an arbitrary position on the girder because an anchoring device for a steel wire can be installed at a body hole so that the most dynamically efficient arrangement of the steel wires is possible for either a simple beam bridge or a continuous bridge, the girder can be easily incrementally prestressed because the steel wire anchoring device is exposed, a long span girder can be made, a tensile force can be easily controlled according to the position and size of the girder and restriction conditions, a plurality of anchoring devices can be exposed, the efficient management of a tensile force during construction is possible, and an reinforcement function through an additional tension after construction is provided.

Also, the present invention provides a hollow prestressed concrete girder and a method of constructing a spliced hollow prestressed concrete girder bridge, which enables movement of wind and water through the hole in the body portion of the girder so that the lateral load resistance of the girder can be improved as the lateral load is reduced.

Also, the present invention provides a hollow prestressed concrete girder and a method of constructing a spliced hollow prestressed concrete girder bridge, which can provide a range of vision through the hole in the body portion so that a sense of being locked in due to the closed body portion of the girder in the conventional girder bridge is removed, aesthetic sense is greatly improved, and inconvenience to residents due to the construction of a bridge can be much reduced.

Also, the present invention provides a hollow prestressed concrete girder and a method of constructing a spliced hollow prestressed concrete girder bridge, which can distribute and fix steel wires according to the distribution of moment generated in the girder by installing a steel wire anchoring device in the hole of the girder so that the amount of steel wires used in the girder is minimized, the size of the section of the girder is reduced, the weight of the girder is reduced by making the size of the section of the end portion of the girder to be the same as the middle portion thereof, and a mold can be simplified.

Technical Solution

According to an aspect of the present invention, a hollow prestressed concrete girder for forming an I-type prestressed concrete girder bridge, wherein at least one hole is formed in a body portion of the I-type prestressed concrete girder.

The hole is formed using a mold with a hole to form the hole before the girder is manufactured or by installing in a mold a mold member such as plastic, a steel member, or Styrofoam that is installed before concrete is poured and detached later.

The girder is spliced into a plurality of spliced girders and a spliced portion is reinforced and connected using a connection member such as a steel bar, a steel rod, or steel wire that is connected by welding, a coupling, or an anchoring device to reinforce a tensile force in a lower portion of the spliced portion that connects the spliced girders.

An anchoring device for fixing a steel wire for tensioning the girder is installed inside the hole.

According to another aspect of the present invention, a spliced hollow prestressed concrete girder bridge, in which a plurality of holes are formed in a body portion of the girder to reduce the weight of the girder, is constructed by carrying a plurality of spliced girders manufactured in a factory to a construction site, assembling the spliced girders in the construction site, first tensing steel wires installed at the entire girder, reinforcing a connection portion between spliced members by a steel rod or steel wire which is connected by welding or using a coupling or anchoring device at the spliced portion that connecting the spliced girders, installing the assembled girders that are first tensed on a pier, installing a continuous steel wire for connecting the installed spliced girders for a continuous bridge, pouring slab in the upper portion of the installed spliced girders, after the slab is cured, second tensing steel wires that have not tensed or the tensed continuous steel wire, and when cracks are generated or excessive sagging occurs after the bridge is constructed, additionally tensing the steel wires.

Advantageous Effects

As described above, according to the hollow prestressed concrete girder and the method of constructing a spliced hollow prestressed concrete girder bridge according to the present invention, the available span of a girder bridge is greatly extended, the costs for manufacturing the girder is reduced, general construction conditions such as manufacturing, carrying, and installing of the girder is remarkably improved by reducing the weight of the girder, a load carrying capacity is increased to an extent equivalent to that of an integral type girder by preventing the lowering of the load carrying capacity of the spliced portion, an appropriate tensile force according to the distribution of the moment is made easy, the efficient management of a tensile force using incremental prestressing during construction is possible, a self-reinforcing function through additional tensioning after construction is provided, forming of a hole in the main body of the girder is simple, the lateral load resistance of the girder can be improved, the feeling of being locked in of a driver can be removed, the aesthetic sense of the outer appearance the girder is greatly improved, and the inconvenience by residents due to the construction of the bridge can be greatly reduced.

BEST MODE FOR CARRYING OUT THE INVENTION

Hereinafter, hollow prestressed concrete girders according to a variety of embodiments of the present invention and a method of constructing a spliced hollow prestressed concrete girder bridge will be described with reference to the accompanying drawings.

Figure 1:
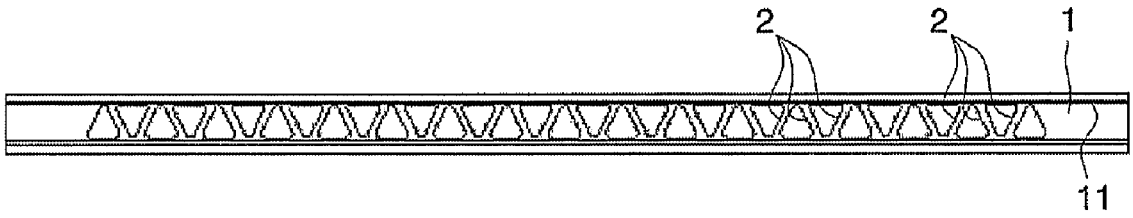
FIG. 1 is a front view of a hollow prestressed concrete girder according to an embodiment of the present invention.
Figure 2:
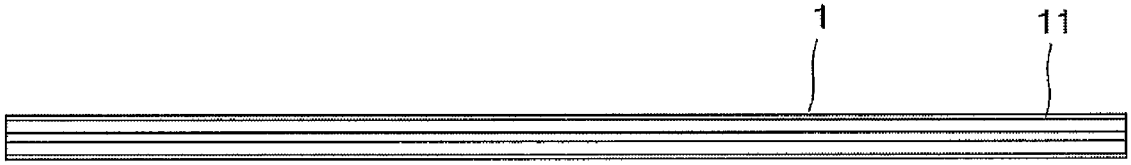
FIG. 2 is a plan view of the hollow prestressed concrete girder of FIG. 1.
Figure 7:
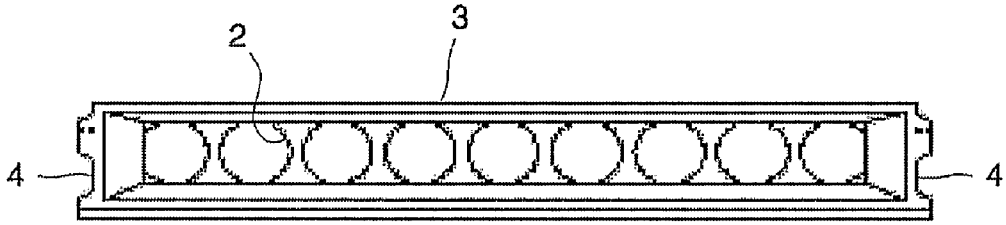
FIGS. 7 through 9 are front views showing various examples of holes of each of spliced girders of the spliced hollow prestressed concrete girder of FIG. 6.
Figure 8:
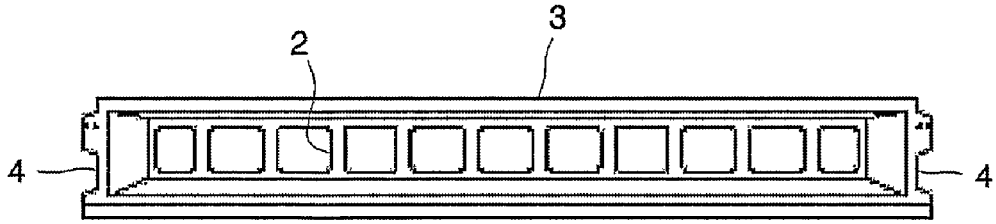
Figure 9:
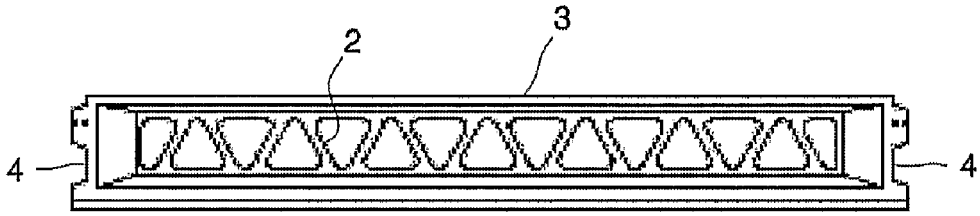
Figure 14:
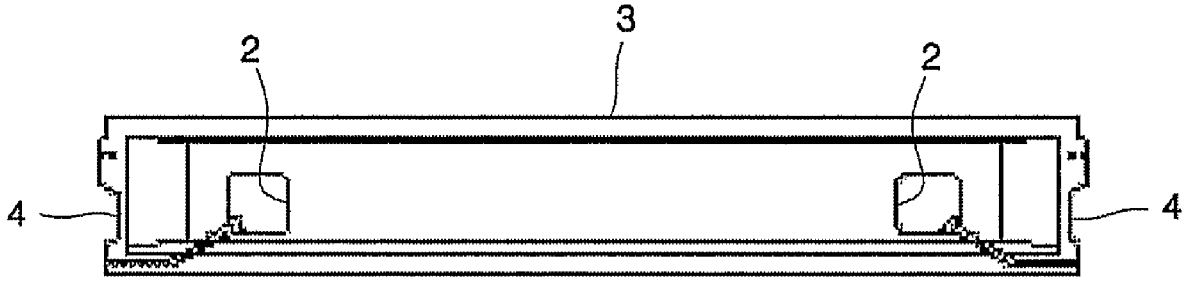
FIGS. 14 through 16 are front views showing various examples of connecting spliced portions with various minimum holes (at least two holes) of each of the spliced girders of a spliced hollow prestressed concrete girder according to yet another embodiment of the present invention.
Figure 15:
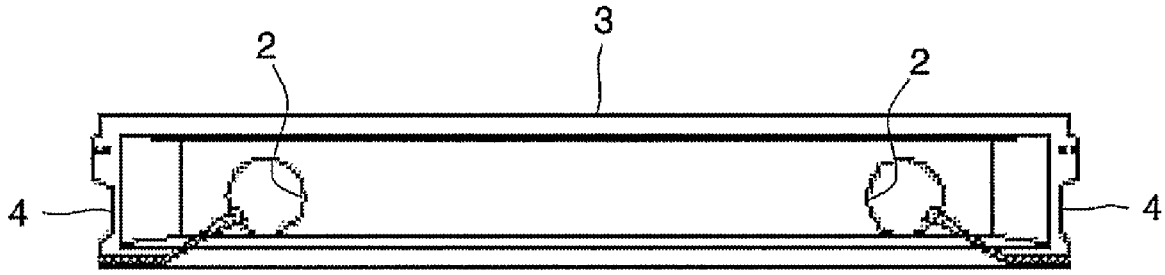
Figure 16:
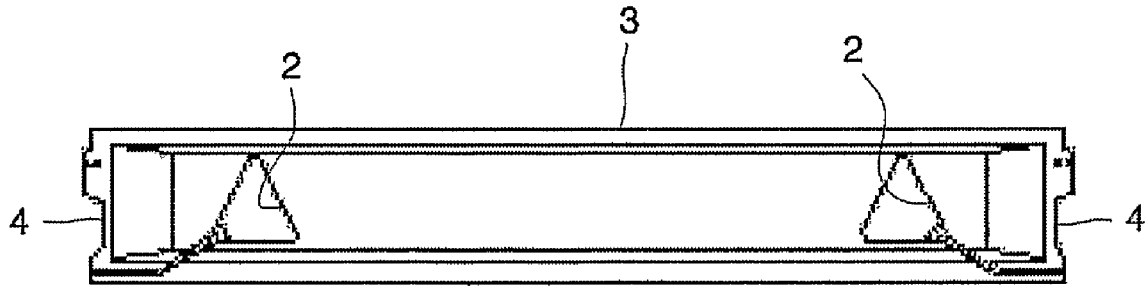

Referring to FIG. 1, a hollow prestressed concrete girder according to an embodiment of the present invention includes a body portion in which a plurality of holes 2 are formed to reduce the weight of an I-type girder 1. The holes 2 can be circular or oval as shown in FIGS. 7 and 15, rectangular as shown in FIGS. 8 and 14, or triangular as shown in FIGS. 9 and 16. In addition, the holes 2 can have various shapes such as a polygon.

The holes 2 can reduce the weight of the I-type girder 1 as much as a portion corresponding to the volume occupied by the holes 2. In addition to the holes 2 shown in the drawings, the holes 2 can be formed in a variety of shapes such as a combination of the circular and polygonal holes. The holes 2 are arranged to have an optimal interval, an optimal shape, and an optimal direction to increase a load carrying capacity to its maximum.

Figure 3:
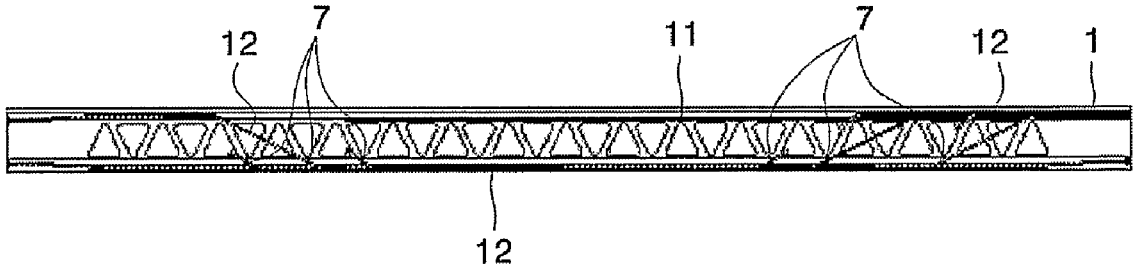
FIG. 3 is a front view showing an example of arrangement of an anchoring device, steel wires, and a hollow prestressed concrete girder according to another embodiment of the present invention, when a continuous bridge is constructed.
Figure 4:
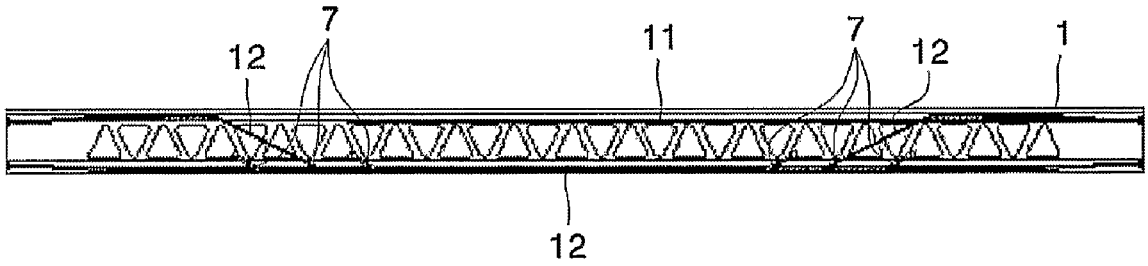
FIG. 4 is a front view showing an example of arrangement of an anchoring device, steel wires, and a hollow prestressed concrete girder according to yet another embodiment of the present invention, when a simple beam bridge is constructed.
Figure 5:
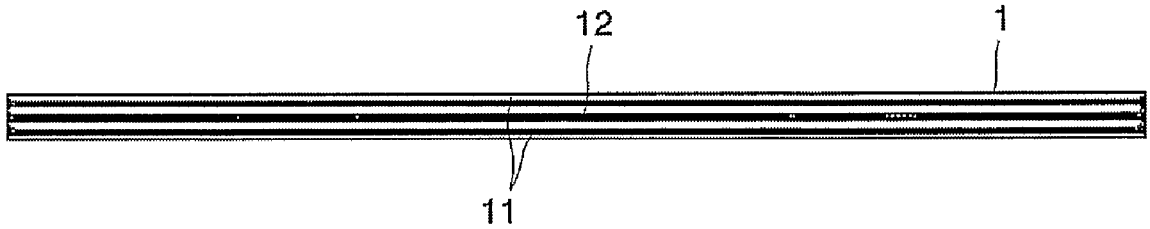
FIG. 5 is a plan view of the hollow prestressed concrete girders of FIGS. 3 and 4.

As shown in FIGS. 3, 4, and 5, a lengthy steel wire 11 for tensioning along the lengthwise direction of the I-type girder 1 can be installed. Also, as shown in FIGS. 3, 4, and 5, an anchoring device 7 can be easily installed in the holes 2 and, in addition to the lengthy steel wire 11, a continuous steel wire 12 fixed by the anchoring device 7 can be installed in a various routes. Also, as shown in FIG. 5, the steel wires are not only installed at the body portion of the girder only, but also installed at an upper or lower flange.

Thus, since the short continuous steel wires 12 are installed to be distributed to the left and right with respect to the center portion of the girder according to the distribution of moment, the size of the end portion of the girder can be manufactured to be the same as the center portion of the girder. Thus, the amount of the steel wires used for the girder can be minimized and the size of the section of the girder can be reduced. Also, by making the size of the section of the end portion of the girder to be the same as the middle portion thereof, the weight of the girder can be reduced and a mold can be simplified.

The lengthy steel wire 11 is not necessary and tensioning can be performed with only the continuous steel wire 12. Although not shown in the drawings, the holes 2 can be manufactured in a variety of methods, for example, using a mold with holes to form the holes before the girder 1 is manufactured or using a mold member such as plastic, a steel member, or Styrofoam that can be installed before concrete is poured and detached later. Thus, the weight of concrete is reduced as much as the space occupied by the holes 2 and simultaneously a structure in which the remaining concrete except for the holes can dynamically support a shear force so that the weight of the girder decreases while the load carrying capacity is maintained.

In addition, resistance to a lateral load of the girder 1 can be improved because the lateral load is reduced as wind and water can flow through the holes 2 of the body portion of the girder 1. Also, since a range of vision through the holes 2 in the body portion is extended, a sense of being locked in due to the closed body portion of a girder in the conventional girder bridge is removed, aesthetic sense is greatly improved, and inconvenience to residents due to the construction of a bridge can be much reduced.

Figure 6:
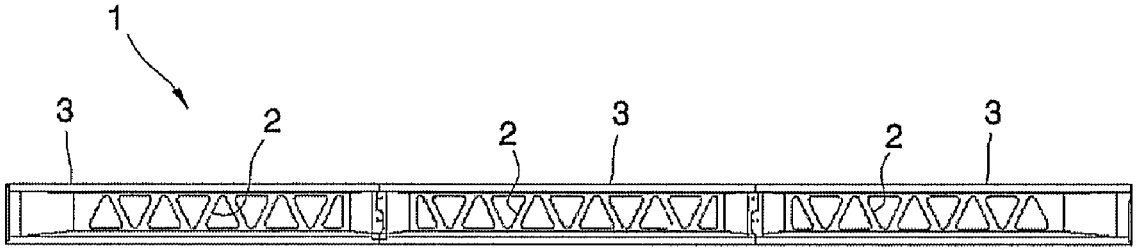
FIG. 6 is a front view of a spliced hollow prestressed concrete girder according to an embodiment of the present invention.
Figure 10:
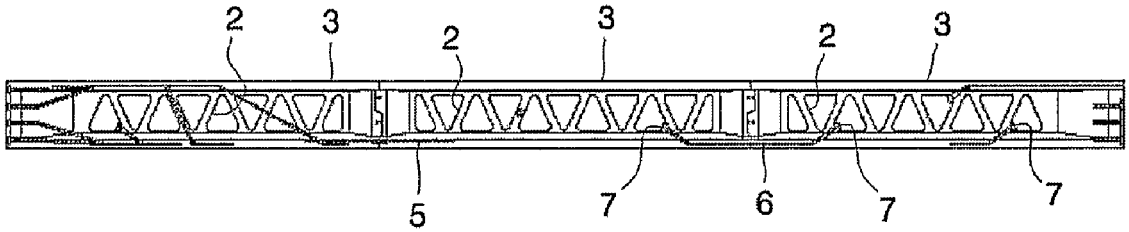
FIG. 10 is a front view of a spliced hollow prestressed concrete girder according to another embodiment of the present invention in which an anchoring device and continuous steel wires are installed.
Figure 11:
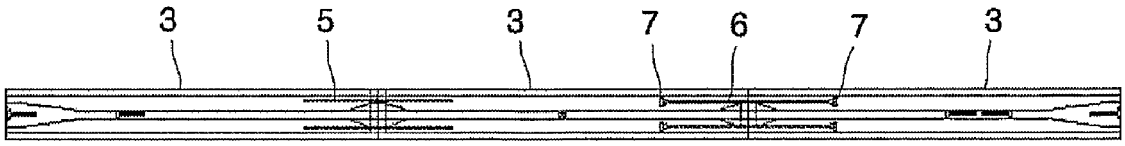
FIG. 11 is a plan view of the spliced hollow prestressed concrete girder of FIG. 10.

Also, as shown in FIG. 6, a hollow prestressed concrete girder according to another embodiment of the present invention is spliced into a plurality of spliced girders 3. That is, as shown in FIGS. 10 and 11, the spliced hollow prestressed concrete girder are connected using a connection member such as a steel bar, a steel rod 5, or a steel wire 6 which are connected by welding or using a coupling or the anchoring device 7 at a spliced portion connecting the spliced girders 3, to reinforce a tensile force of the lower end of the girder 1. Also, since the spliced girder 3 can be assembled at a construction site, general construction conditions such as carrying and installing of the girder can be greatly improved.

Figure 12:
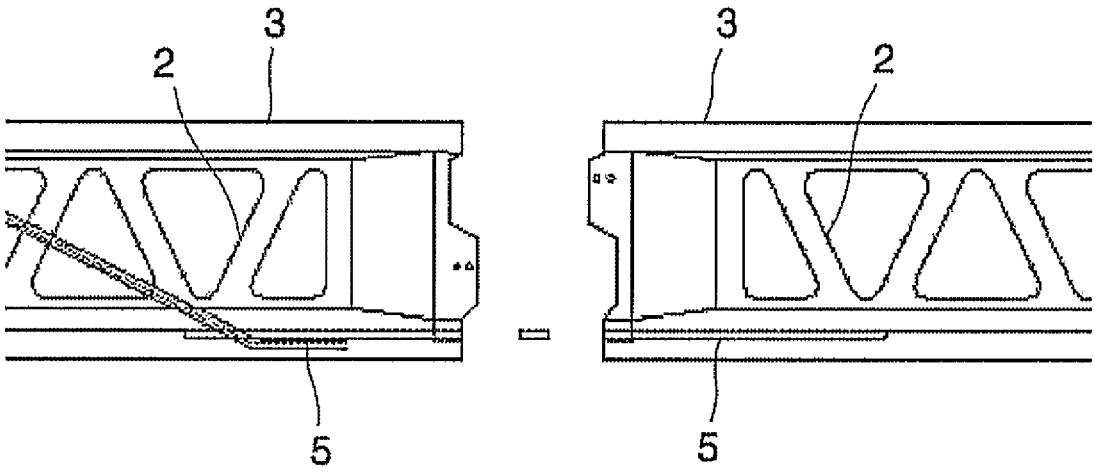
FIG. 12 is a partially enlarged view of a spliced portion of FIG. 6 when a connection reinforcement member is a steel rod or steel rod.
Figure 13:
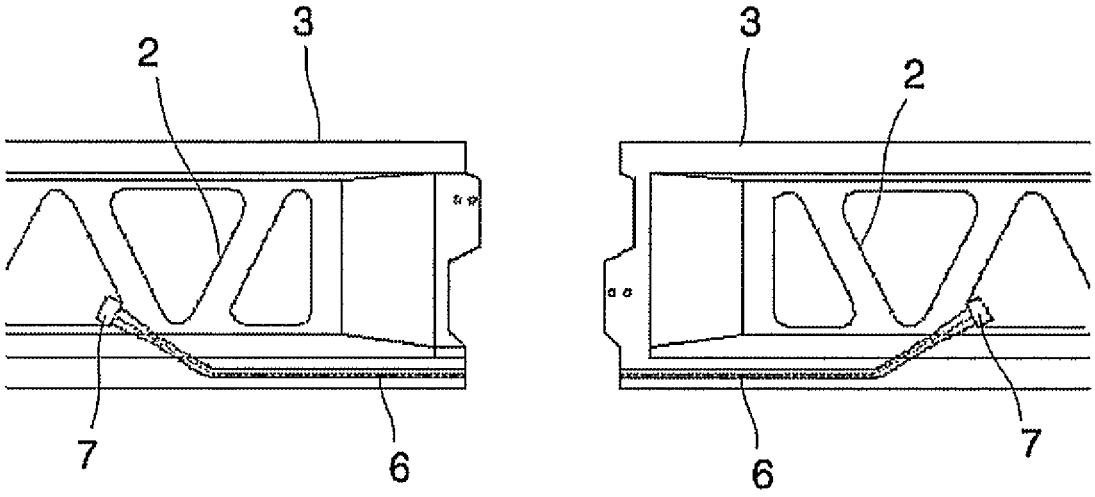
FIG. 13 is a partially enlarged view of a spliced portion of FIG. 6 when a connection reinforcement member is a steel wire.

As shown in FIG. 12, the connection member may be the steel rod 5 or an embedded steel bar installed across the lower portion of the girder 1 that is welded together or connected by a coupling so that the load carrying capacity of the spliced portion 4 is increased. Alternatively, as shown in FIG. 13, the steel wire 6 is installed across the lower portion of the girder 1 and the anchoring device 7 for the steel wire 6 is installed in the holes 2. Thus, a plurality of anchoring devices 7 can be exposed to the outside so that an efficient tension management using incremental prestressing during construction is possible and a reinforcing function through additional tensioning after construction can be obtained.

FIGS. 10 and 11 show embodiments of methods of arranging the steel rod 5, the steel wire 6, and the anchoring device 7. The anchoring devices 7 installed at the end portion of the girder and the holes of the girder. The drawings also show how the steel wire can be arranged inside the girder. For a continuous bridge, the steel wire can be installed in the upper portion of the girder. FIG. 11 shows that the reinforced steel rod and the steel wire of the spliced portion can be arranged in a flange portion, not the body portion.

Thus, in the hollow prestressed concrete girder bridge according to the present invention, since the weight of the girder is much reduced, an I-type girder bridge having a long span of over 70 m can be constructed. Since a solution to increase the load carrying capacity of the spliced portion 4 is suggested, a girder with a long span can be manufactured in a factory.

As shown in FIGS. 14 through 16, instead of forming a plurality of holes in the body portion of the spliced girder 3 to reduce the weight of the girder, at least one pair of holes can be formed around the spliced portion 4 of the spliced girder 3 to reinforce the spliced portion 4.

Figure 17:
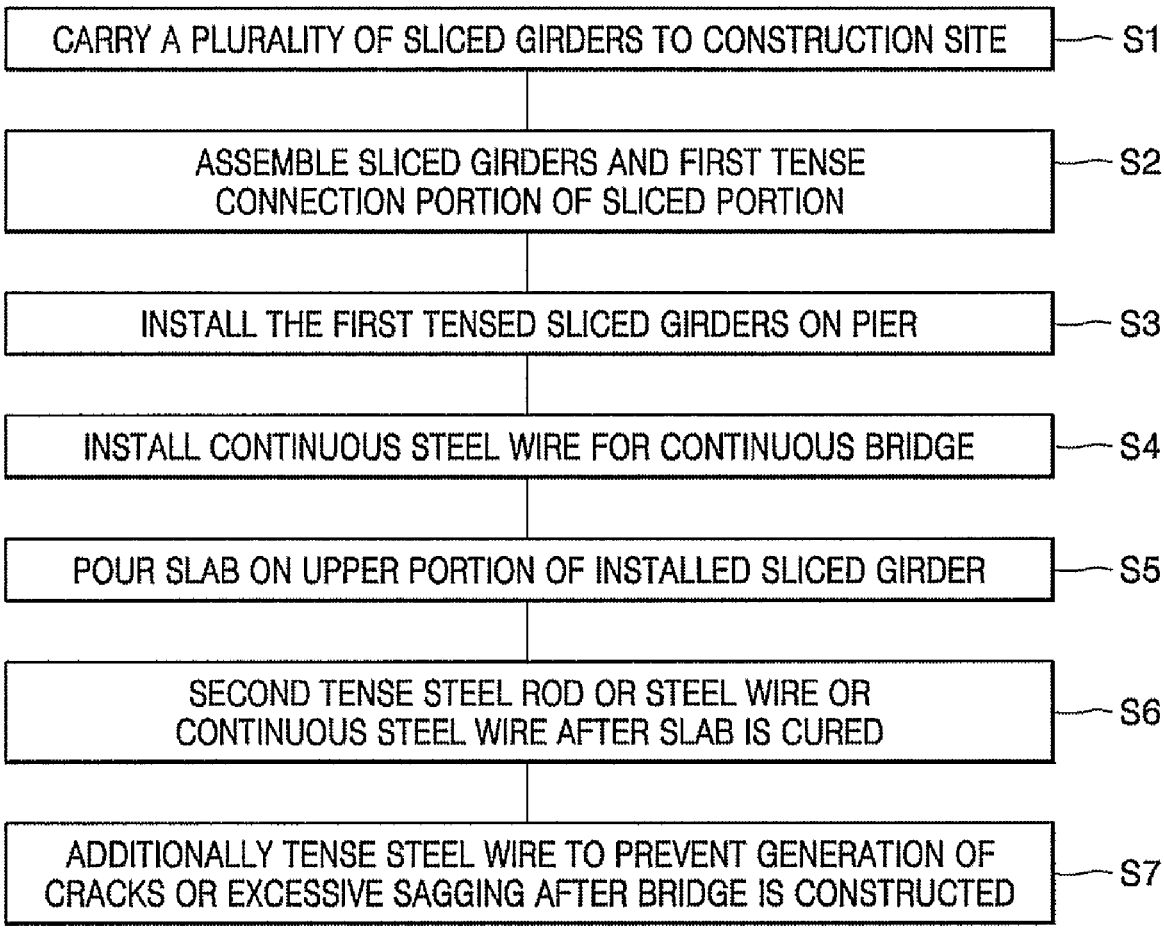
FIG. 17 is a flow chart for explaining a method of constructing a spliced hollow prestressed concrete girder according to an embodiment of the present invention.

In a method of constructing a hollow prestressed concrete girder bridge according to the present invention, as shown in FIG. 17, a plurality of spliced girders manufactured in a factory are carried to a construction site (S1), the spliced girders are assembled in the construction site, steel wires installed at the entire girder are first tensed, a connection portion between spliced members are reinforced by a steel rod or steel wire which is connected by welding or using a coupling or anchoring device at the spliced portion that connecting the spliced girders (S2), the assembled girders that are first tensed are installed on a pier (S3), for a continuous bridge, a continuous steel wire for connecting the installed spliced girders is installed (S4), slab is poured in the upper portion of the installed spliced girders (S5), after the slab is cured, steel wires that have not tensed are second tensed or the continuous steel wire is tensed (S6), and when cracks are generated or excessive sagging occurs after the bridge is constructed, the steel wires are additionally tensed and reinforced (S7).

Thus, a plurality of anchoring devices can be exposed and an efficient tension management using incremental prestressing is possible during construction. When the bridge is damaged after construction, a self-reinforcing function through additional tensioning is provided.

While this invention has been particularly shown and described with reference to preferred embodiments thereof, it will be understood by those skilled in the art that various changes in form and details may be made therein without departing from the spirit and scope of the invention as defined by the appended claims. For example, various shapes and numbers of the holes are available and the tension of the spliced portion can be reinforced in a variety of methods in addition to the method using a steel wired or a steel rod.

The invention claimed is:

1. A hollow prestressed concrete girder for forming an I-type prestressed concrete girder bridge, wherein at least one hole is formed in a body portion of the I-type prestressed concrete girder in a direction transverse to the body portion, wherein an anchoring device for fixing a steel wire for tensioning the girder is coupled to the hole of the body portion, and wherein at least a portion of the anchoring device is externally exposed from the body portion.

2. The hollow prestressed concrete girder of claim 1, wherein the shape of the hole is one of a circle, a triangle, a rectangle, an oval, a polygon, and a combination thereof.

3. The hollow prestressed concrete girder of claim 1, wherein the hole is formed using a mold with a hole to form the hole before the girder is manufactured or by installing in a mold a mold member including plastic, a steel member, or Styrofoam that is installed before concrete is poured and detached later.

4. The hollow prestressed concrete girder of claim 1, wherein at least one relatively-short steel wire is mounted to the left and right of the girder to distribute the tensile force according to the distribution of moment in the girder, and due to the tensioning relatively-short steel wire, the size of two end portions of the girder is manufactured to be the same as the size of a middle portion of the girder.

5. A hollow prestressed concrete girder for forming an I-type prestressed concrete girder bridge, wherein at least one hole is formed in a body portion of the I-type prestressed concrete girder in a direction transverse to the body portion, and wherein the girder is spliced into a plurality of spliced girders.

6. The hollow prestressed concrete girder of claim 5, wherein a spliced portion is reinforced and connected to another spliced portion using a connection member comprising a steel bar, a steel rod, or steel wire, and wherein the connection member connects neighboring spliced girders by welding a coupling or using an anchoring device to reinforce a tensile force in a lower portion of the spliced portion that connects the spliced girders.

7. The hollow prestressed concrete girder of claim 5, wherein the shape of the hole is one of a circle, a triangle, a rectangle, an oval, a polygon, and a combination thereof.

8. The hollow prestressed concrete girder of claim 5, wherein the hole is formed using a mold with a hole to form the hole before the girder is manufactured or by installing in a mold a mold member including plastic, a steel member, or Styrofoam that is installed before concrete is poured and detached later.

9. The hollow prestressed concrete girder of claim 5, wherein at least one relatively-short steel wire is mounted to the left and right of the girder to distribute the tensile force according to the distribution of moment in the girder, and due to the tensioning relatively-short steel wire, the size of two end portions of the girder is manufactured to be the same as the size of a middle portion of the girder.

10. A hollow prestressed concrete girder for forming an I-type prestressed concrete girder bridge, wherein at least one hole is formed in a body portion of the I-type prestressed concrete girder in a direction transverse to the body portion, wherein the girder is spliced into a plurality of spliced girders and a spliced portion is reinforced and connected to another spliced portion using a connection member comprising a steel bar, a steel rod, or steel wire, and wherein the connection member connects neighboring spliced girders by welding a coupling or using an anchoring device to reinforce a tensile force in a lower portion of the spliced portion that connects the spliced girders, wherein an anchoring device for fixing a continuous steel wire for tensioning the girder is coupled to the hole of the body portion, wherein at least one relatively-short steel wire is mounted to the left and right of the girder to distribute the tensile force according to the distribution of moment in the girder, and due to the tensioning relatively-short steel wire, the size of two end portions of the girder is manufactured to be the same as the size of a middle portion of the girder, wherein the continuous steel wire fixed by the anchoring device is installed in a various route at an arbitrary position around the girder, such that the tensile force is managed efficiently during construction and an reinforcement function through an additional tension after construction is provided, and wherein at least a portion of the anchoring device is externally exposed from the body portion.

11. The hollow prestressed concrete girder of claim 10, wherein the shape of the hole is one of a circle, a triangle, a rectangle, an oval, a polygon, and a combination thereof.

12. The hollow prestressed concrete girder of claim 10, wherein the hole is formed using a mold with a hole to form the hole before the girder is manufactured or by installing in a mold a mold member including plastic, a steel member, or Styrofoam that is installed before concrete is poured and detached later.

* * * * *